US010627155B2

(12) United States Patent
Okada

(10) Patent No.: US 10,627,155 B2
(45) Date of Patent: Apr. 21, 2020

(54) ULTRA-LOW TEMPERATURE FREEZER

(71) Applicant: PHC HOLDINGS CORPORATION, Tokyo (JP)

(72) Inventor: Tadashi Okada, Saitama (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 0 days.

(21) Appl. No.: 16/128,437

(22) Filed: Sep. 11, 2018

(65) Prior Publication Data

US 2019/0011176 A1 Jan. 10, 2019

Related U.S. Application Data

(63) Continuation of application No. PCT/JP2017/008316, filed on Mar. 2, 2017.

(30) Foreign Application Priority Data

Mar. 11, 2016 (JP) ..... 2016-048222

(51) Int. Cl.
*F25D 23/08* (2006.01)
*F25D 23/02* (2006.01)
*F25D 11/04* (2006.01)

(52) U.S. Cl.
CPC ..... *F25D 23/087* (2013.01); *F25D 11/04* (2013.01); *F25D 23/02* (2013.01); *F25D 23/028* (2013.01)

(58) Field of Classification Search
CPC ..... F25D 23/028; F25D 23/087; F25D 11/04
(Continued)

(56) References Cited

U.S. PATENT DOCUMENTS 2,908,949 A * 10/1959 Frehse ..... F25D 23/087 49/496.1
2,968,845 A * 1/1961 Dickinson ..... F25D 23/087 49/496.1

(Continued)

FOREIGN PATENT DOCUMENTS

JP 29-015165 11/1954
JP 57-100666 U 6/1982

(Continued)

OTHER PUBLICATIONS

International Search Report and Written Opinion issued in International Patent Application No. PCT/JP2017/008316 dated May 23, 2017; with partial English translation

*Primary Examiner* — James O Hansen
(74) *Attorney, Agent, or Firm* — McDermott Will & Emery LLP

(57) ABSTRACT

Disclosed is an ultra-low temperature freezer comprising a seal. The seal member has: hollow first and second air layer forming portions which are aligned in a row in a second direction between a first and second peripheral edges when a door is closed; and a first connection portion which is connected between the first and second air layer forming portions so as to form an air layer. The first connection portion has a shape that would overlap part of the first and second air layer forming portions if moved in parallel to the second direction. The outer peripheral surface of the first connection portion and the outer peripheral surfaces of the first and second air layer forming portions form first and second recessed portions extending in a first direction.

14 Claims, 6 Drawing Sheets

(58) Field of Classification Search
USPC ..... 312/296, 401, 405; 62/440, 531; 49/475.1, 478.1, 495.1, 498.1
See application file for complete search history.

(56) References Cited

U.S. PATENT DOCUMENTS

| | | | | | |
|---|---|---|---|---|---|
| 3,078,134 | A * | 2/1963 | Haynes, Jr. | F25D 23/028 | 312/296 |
| 3,178,778 | A * | 4/1965 | Reahard | F25D 23/087 | 49/496.1 |
| 4,138,049 | A * | 2/1979 | McAlarney | F25D 23/087 | 277/629 |
| 4,462,646 | A * | 7/1984 | Fleck | F25D 23/082 | 312/140 |
| 4,826,010 | A * | 5/1989 | Jahr, Jr. | B29C 44/18 | 220/592.1 |
| 5,289,657 | A * | 3/1994 | Kiel | F25D 23/082 | 49/478.1 |
| 8,944,539 | B2 * | 2/2015 | Ramm | F25D 23/087 | 312/296 |
| 2010/0326109 | A1 | 12/2010 | Tobe et al. | | |
| 2012/0103992 | A1 | 5/2012 | Takahashi | | |

FOREIGN PATENT DOCUMENTS

| | | | |
|---|---|---|---|
| JP | 3018297 | U | 11/1995 |
| JP | H11-311477 | A | 11/1999 |
| JP | 2005-147476 | A | 6/2005 |
| JP | 2006-046852 | A | 2/2006 |
| JP | 2010-096490 | A | 4/2010 |
| JP | 2012-093055 | A | 5/2012 |
| JP | 5671675 | B2 | 2/2015 |

* cited by examiner

ULTRA-LOW TEMPERATURE FREEZER

CROSS-REFERENCE OF RELATED APPLICATIONS

This application is the U.S. Continuation of International Patent Application No. PCT/JP2017/008316, filed on Mar. 2, 2017, which in turn claims the benefit of Japanese Application No. 2016-048222, filed on Mar. 11, 2016, the entire disclosures of which Applications are incorporated by reference herein.

TECHNICAL FIELD

The present disclosure relates to an ultra-low temperature freezer that includes a housing and a seal member interposed between the housing and a closed door.

BACKGROUND ART

As a technique related to such an ultra-low temperature freezer, a door apparatus, for example, is described in Patent Literature (PTL) 1 for a cooling storage cabinet. With this door apparatus, when an outer door is closed, a cabinet-interior-end surface of a flange abuts an entry lip on an outer side of the cabinet via packing that serves as a seal member. It is to be noted here that in this door apparatus, the cabinet-interior-end abutment surface and an abutment surface of the packing are both flat.

CITATION LIST

Patent Literature

PTL 1
Japanese Patent Application Laid-Open No. 2005-147476

SUMMARY OF INVENTION

Technical Problem

Enhanced thermal insulation and enhanced hermeticity are required of an ultra-low temperature freezer having an ultra-low internal temperature range (e.g. not more than −50° C.). As such, the ultra-low temperature freezer differs from a domestic refrigerator or the like in that a door is secured to a housing by a lock mechanism while being pressed hard against the housing by a user. With a cabinet-interior-end abutment surface being flat and with an abutment surface of packing being flat as with the conventional seal member, the door may be hard to open when the abutment surface of the packing freezes onto the cabinet-interior-end surface because of moisture between the cabinet-interior-end abutment surface and the abutment surface of the packing.

In view of the above problem, an object of the present disclosure is to provide an ultra-low temperature freezer including a seal member that can reduce freezing-induced difficulty in door opening.

Solution to Problem

The present disclosure is directed to an ultra-low temperature freezer including: a housing including a first peripheral part around an opening; a door mounted to the housing to be openable, the door including a second peripheral part that the first peripheral part faces in a first direction when the door is closed; and a seal member that is interposed between the first and second peripheral parts when the door is closed, in which the seal member includes: a first air layer defining part and a second air layer defining part that are hollow and line up in a second direction between the first and second peripheral parts when the door is closed; and a first connecting part defining a bridge between the first and second air layer defining parts, the first connecting part forming an air layer, in which the first connecting part has a shape that overlies a portion of each of the first and second air layer defining parts when a virtual parallel displacement in the second direction is caused to the first connecting part, and in which an outer peripheral surface of the first connecting part forms a first recess that extends in the first direction with an outer peripheral surface of the first air layer defining part and forms a second recess that extends in the first direction with an outer peripheral surface of the second air layer defining part.

Advantageous Effect of Invention

According to the above disclosure, the ultra-low temperature freezer that can be provided includes the seal member capable of reducing freezing-induced difficulty in opening the outer door.

DESCRIPTION OF EMBODIMENT

1. Embodiment

Figure 1:
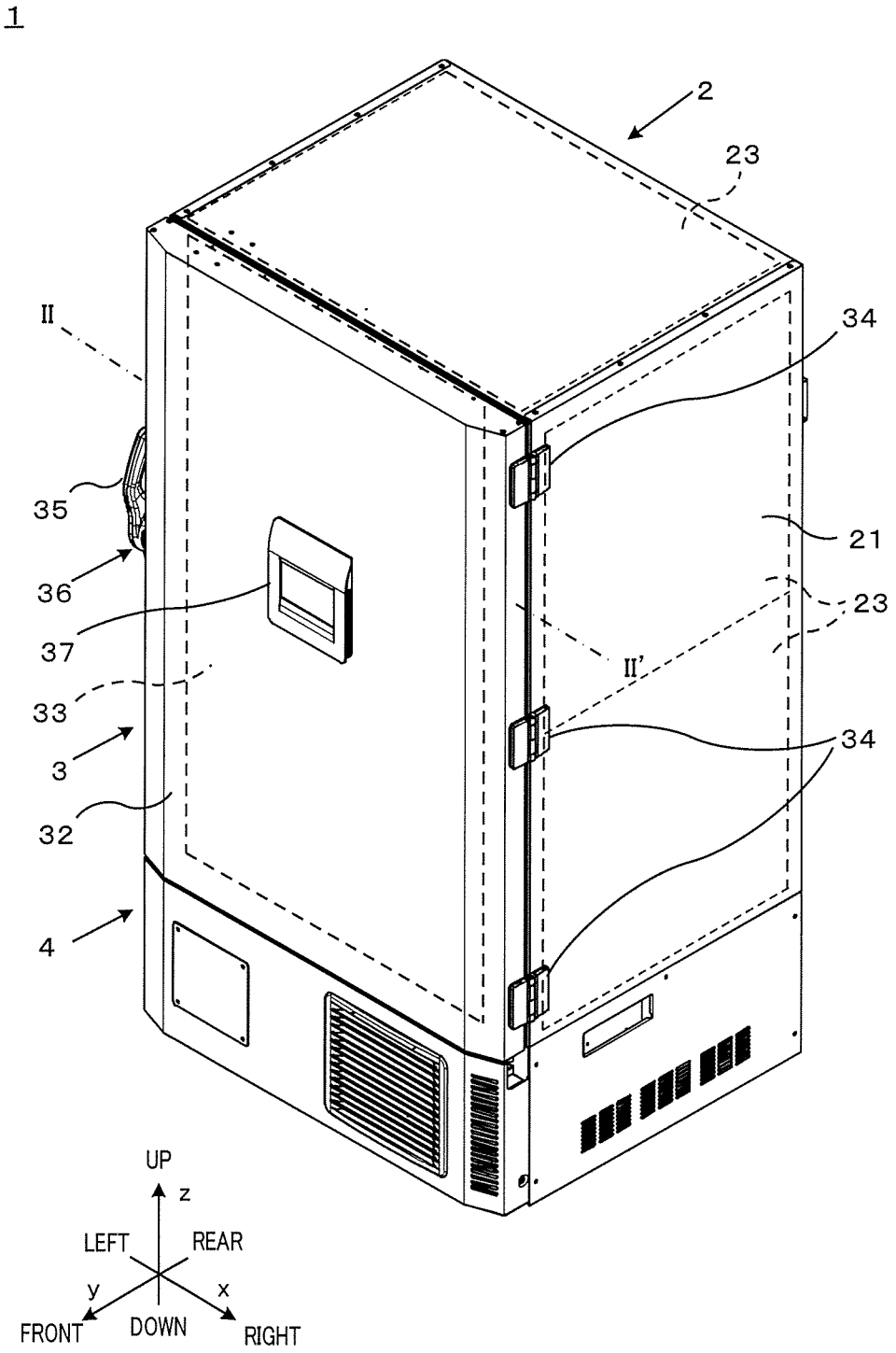
FIG. 1 is a perspective view of an ultra-low temperature freezer according to an embodiment of the present disclosure.

With reference to the above drawings, a detailed description is hereinafter provided of ultra-low temperature freezer 1 according to an embodiment of the present disclosure.

1-1. Definition

In the drawings, an x-axis indicates a transverse direction of ultra-low temperature freezer 1 and more specifically, a left to right direction when a user faces ultra-low temperature freezer 1. A y-axis indicates a front-back direction of ultra-low temperature freezer 1 and more specifically, a rear to front direction (i.e. a forward direction) when the user faces ultra-low temperature freezer 1. A z-axis indicates a vertical direction of ultra-low temperature freezer 1 and more specifically, a perpendicularly upward direction from an ultra-low temperature freezer installation surface (that is substantially horizontal).

1-2. Schematic Structure of Ultra-Low Temperature Freezer 1

Figure 2:
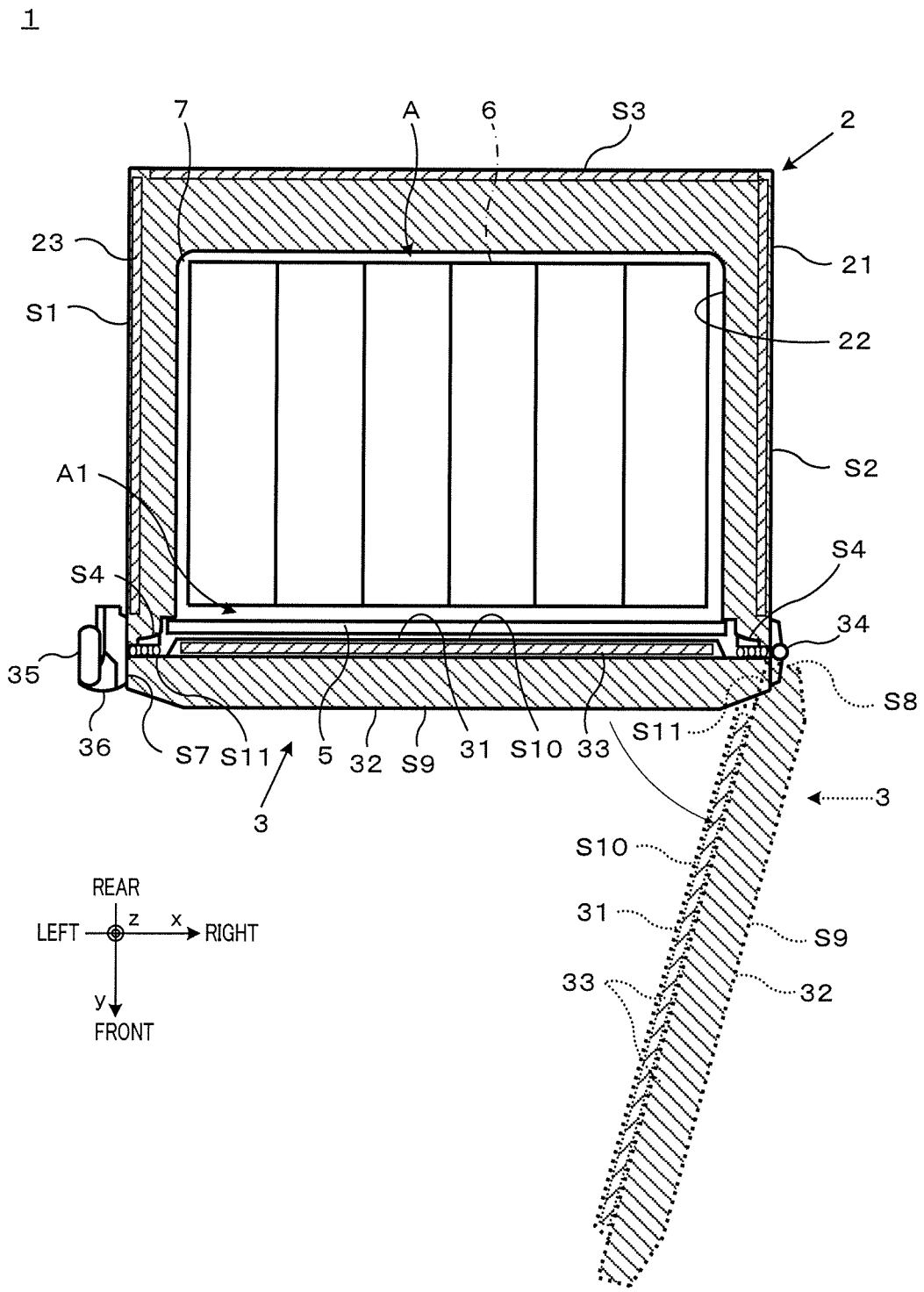
FIG. 2 is a cross section of the ultra-low temperature freezer, as viewed from above, the cross section being taken along line II-II' of FIG. 1.
Figure 3:
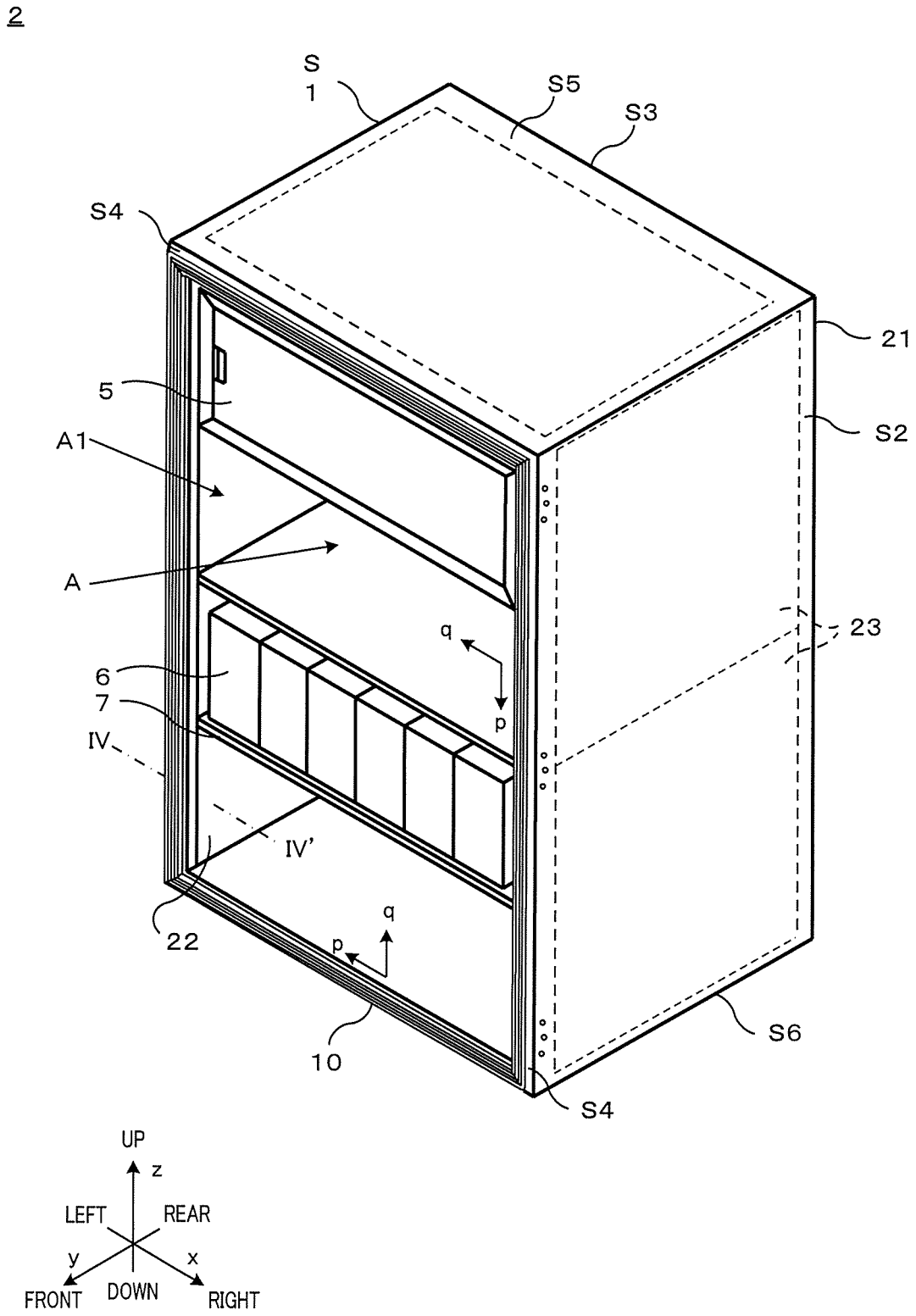
FIG. 3 is a perspective view of a housing illustrated in FIG. 1 with an outer door and a plurality of inner doors removed.

As illustrated in FIGS. 1 to 3, ultra-low temperature freezer 1 basically includes housing 2, outer door 3, and machinery compartment 4. It is to be noted that in FIG. 1, constituent elements that cannot be visually recognized exteriorly, such as thermal insulators 23, 33 which are described later, are indicated by broken lines.

Housing 2 generally includes exterior body 21 and interior body 22 that are made of, for example, metal, and a plurality of thermal insulators 23. Exterior body 21 defines an outside shape of housing 2. Interior body 22 is provided inside exterior body 21 and defines space (hereinafter referred to as "storage space") A for accommodating objects to store. A forward edge (hereinafter referred to as "opening A1") of storage space A is substantially rectangular and is parallel to a z-x plane. Each of the plurality of thermal insulators 23 is preferably formed of, for example, a laminate of a vacuum insulated panel and polyurethane. It is to be noted that FIGS. 1 and 2 do not illustrate all of the plurality of thermal insulators 23 for convenience' sake. More specifically, only those thermal insulators 23 indicated in FIG. 1 by the broken lines include two thermal insulators 23 that are interposed between a right side of exterior body 21 and a right side of interior body 22 and one thermal insulator 23 that is interposed between a top side of exterior body 21 and a top side of interior body 22. In FIG. 2, thermal insulators 23 that are respectively provided at a left side, a right side, and a rear side of housing 2 are illustrated. The vacuum insulated panel of thermal insulator 23 is indicated by leftward hatching, while the polyurethane of thermal insulator 23 is indicated by rightward hatching.

Outer door 3 includes interior body 31 and exterior body 32 that are made of, for example, metal, and at least one thermal insulator 33 disposed in a space between interior body 31 and exterior body 32. Outer door 3 is openable by being rotated about respective pivots of, for example, three hinges 34 through user operation. When closed, outer door 3 closes opening A1. On the other hand, when outer door 3 is opened, the user can open and close inner door 5 which is described later. Similarly to thermal insulator 23, thermal insulator 33 is preferably formed of a combination of a vacuum insulated panel and polyurethane. It is to be noted that in FIG. 1, this one thermal insulator 33 is illustrated by the broken line. In FIG. 2, the vacuum insulated panel of that one thermal insulator 33 is provided at inner surface S10 of outer door 3 (refer to leftward hatching), while the polyurethane of that thermal insulator 33 is provided between the vacuum insulated panel and exterior body 32 (refer to rightward hatching).

Outer door 3 is also provided with handle 35 that the user holds to open and close outer door 3. In the present embodiment, handle 35 has lock mechanism 36. Lock mechanism 36 locks outer door 3 that is closed, and unlocks to allow opening of outer door 3. With outer door 3 locked by lock mechanism 36, hermeticity and thermal insulation of ultra-low temperature freezer 1 can be enhanced.

Outer door 3 is also provided with control panel 37 at its outer face. Control panel 37 internally has a control circuit board (not illustrated) and has a touch panel that enables operation and visual recognition by the user. The touch panel is a device that, for example, enables the user to set a target temperature (i.e. a target value for internal temperature) of storage space A and others and displays various information items including a currently preset temperature (the target value for the internal temperature).

Machinery compartment 4 is provided, for example, below housing 2. Machinery compartment 4 houses a well-known binary refrigerating system (also called cascade cycle). It is to be noted, however, that not all elements of the binary refrigerating system are housed by machinery compartment 4. A lower-temperature-side evaporator is disposed between exterior body 21 and interior body 22 of housing 2 to surround storage space A, and a cascade condenser is disposed at a rear of storage space A. Machinery compartment 4 houses the other elements. A detailed description of the binary refrigerating system is provided by Japanese Patent Application Laid-Open No. 2010-096490 and others and thus is not provided in the present embodiment.

Machinery compartment 4 may be internally provided with two unitary multistage refrigeration cycles that are controlled independently of each other. In this case, respective evaporators of the unitary multistage refrigeration cycles are disposed in housing 2 to surround storage space A. Even when a problem is caused to one of the unitary multistage refrigeration cycles, storage space A is maintained in an ultra-low temperature range by the other unitary multistage refrigeration cycle.

Ultra-low temperature freezer 1 preferably also includes at least one inner door 5 and at least one storage box 6.

Inner door 5 is made of, for example, resin and rotates on at least one inner-door hinge (not illustrated) about a pivot that is positioned at a right edge of opening A1 in parallel relation with the z-axis. This inner door 5 is opened and closed by the user. When closed, inner door 5 closes at least a part of opening A1. On the other hand, with inner door 5 opened, the user can access storage space A. Inner door 5 such as the above can enhance a thermal insulation effect on storage space A.

Storage box 6 accommodates objects to store and is mounted on rack 7 that is provided in storage space A. To remove the objects in storage from storage box 6, the user opens outer door 3 and inner door 5 first and then pulls storage box 6 out of storage space A.

1-3. Respective Exteriors of Housing 2 and Outer Door 3

As illustrated in FIGS. 2 and 3, an exterior of housing 2 includes housing-end left side S1, housing-end right side S2, rear side S3, housing-end peripheral part S4, top face S5, and bottom face S6.

Left side S1 faces right side S2 in the left to right direction, and left side S1 and right side S2 are each formed of, for example, a plane surface that is generally parallel to a y-z plane. Right side S2 faces left side S1 at a position that is about 1,030 mm away from left side S1 in the transverse direction (i.e. in the direction indicated by the x-axis).

Rear side S3 faces peripheral part S4 in the rear to front direction, and rear side S3 and peripheral part S4 each include, for example, a surface that is generally parallel to the z-x plane. Peripheral part S4 is a first peripheral part and faces rear side S3 in a position that is about 793 mm away from rear side S3 in the direction indicated by the y-axis. This peripheral part S4 surrounds opening A1 from all quarters (namely, from above, below, left, and right) along a periphery of opening A1.

Bottom face S6 faces top face S5 in the vertical direction, and top face S5 and bottom face S6 each include, for example, a surface that is generally parallel to an x-y plane. Top face S5 faces bottom face S6 at a position that is about 1,540 mm away from bottom side S6 in the vertical direction (i.e. in the direction indicated by the z-axis).

As illustrated in FIG. 2, an exterior of outer door 3 includes door-end left side S7, door-end right side S8, outer face S9, inner face S10, and door-end peripheral part S11. It is to be noted that FIG. 2 illustrates outer door 3 both in its closed position and in its opened position which is indicated by broken lines.

With outer door 3 closed, left side S7 faces right side S8 in the left to right direction, and left side 87 and right side S8 each include, for example, a surface that is generally parallel to the y-z plane. Right side S8 faces left side S7 at a position that is about 1,030 mm away from left side S7 in the direction indicated by the x-axis. Left side S7 and right side S8 head forward (i.e. in the direction indicated by the y-axis), respectively starting from a left edge and a right edge of inner face S10 which is described later. It is to be noted here that left side S7 and right side S8 each have a y-axis length of, for example, about 60 mm.

With outer door 3 closed, inner face S10 faces outer face S9 in the rear to front direction. When outer door 3 is closed, inner face S10 closes opening A1. Outer face S9 is at most about 90 mm away from inner face S10 in the forward direction (i.e. in the direction indicated by the y-axis).

Door-end peripheral part S11 is a second peripheral part, defines an outer peripheral part of inner face S10 and includes a surface that is generally parallel to the z-x plane when outer door 3 is closed. When outer door 3 is closed, peripheral part S4 faces, via seal member 10 which is described later, peripheral part S11 in the direction that is indicated as an example of a first direction by the y-axis.

1-4. Breakers 8, 9 and Seal Member 10

Figure 4A:
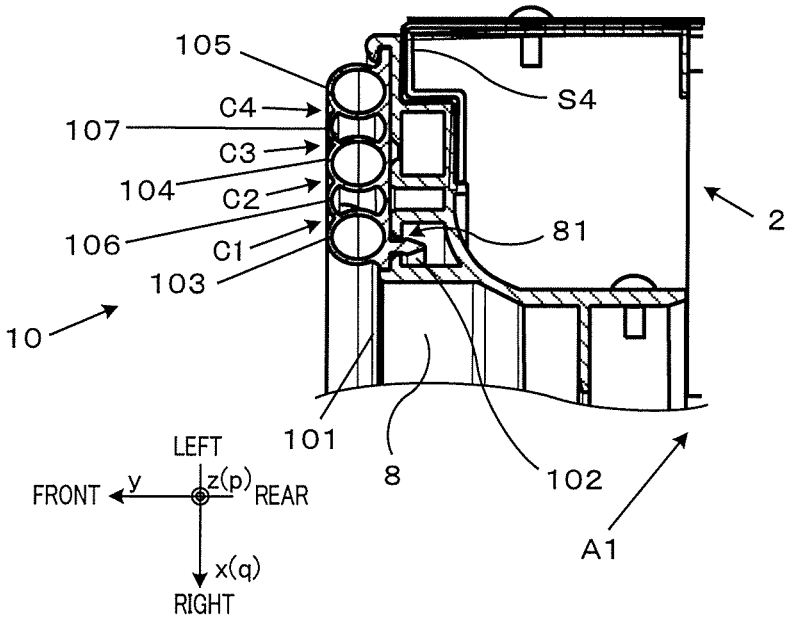
FIG. 4A is a cross section of the ultra-low temperature freezer (with the outer door opened), as viewed in perspective from above, the cross section being taken along line IV-IV' of FIG. 3.
Figure 4B:
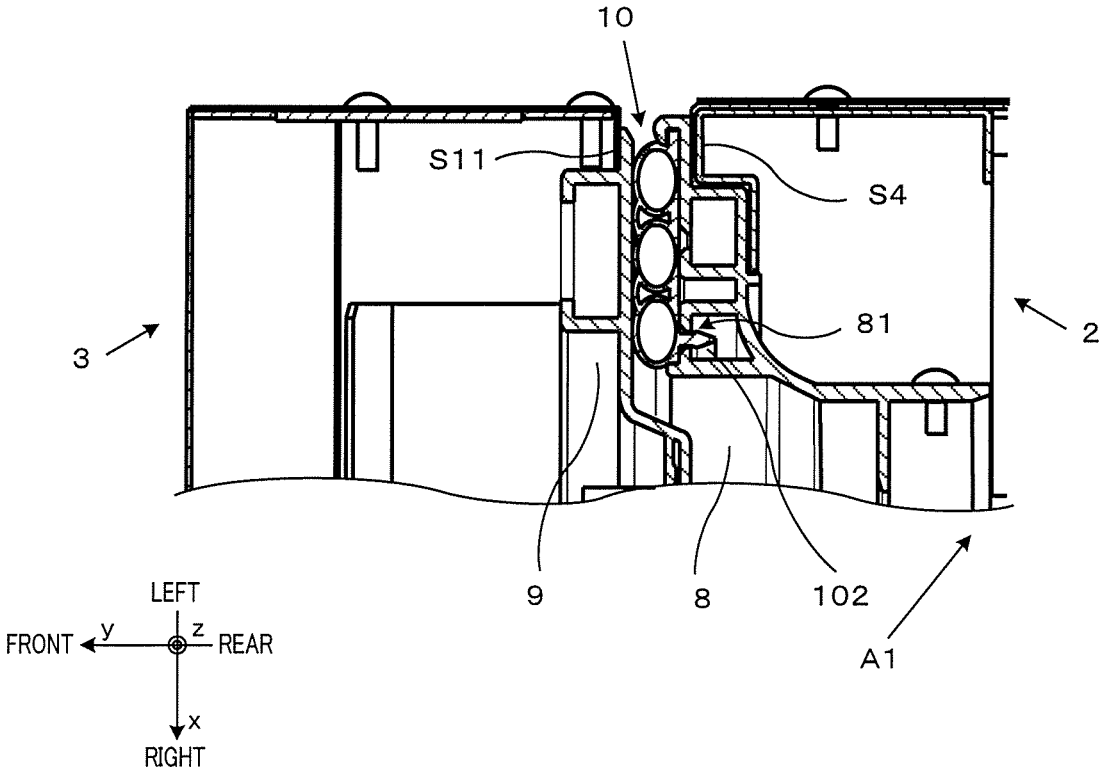
FIG. 4B is a cross section of the ultra-low temperature freezer (with the outer door closed), as viewed in perspective from above, the cross section being taken along line IV-IV' of FIG. 3.
Figure 5:
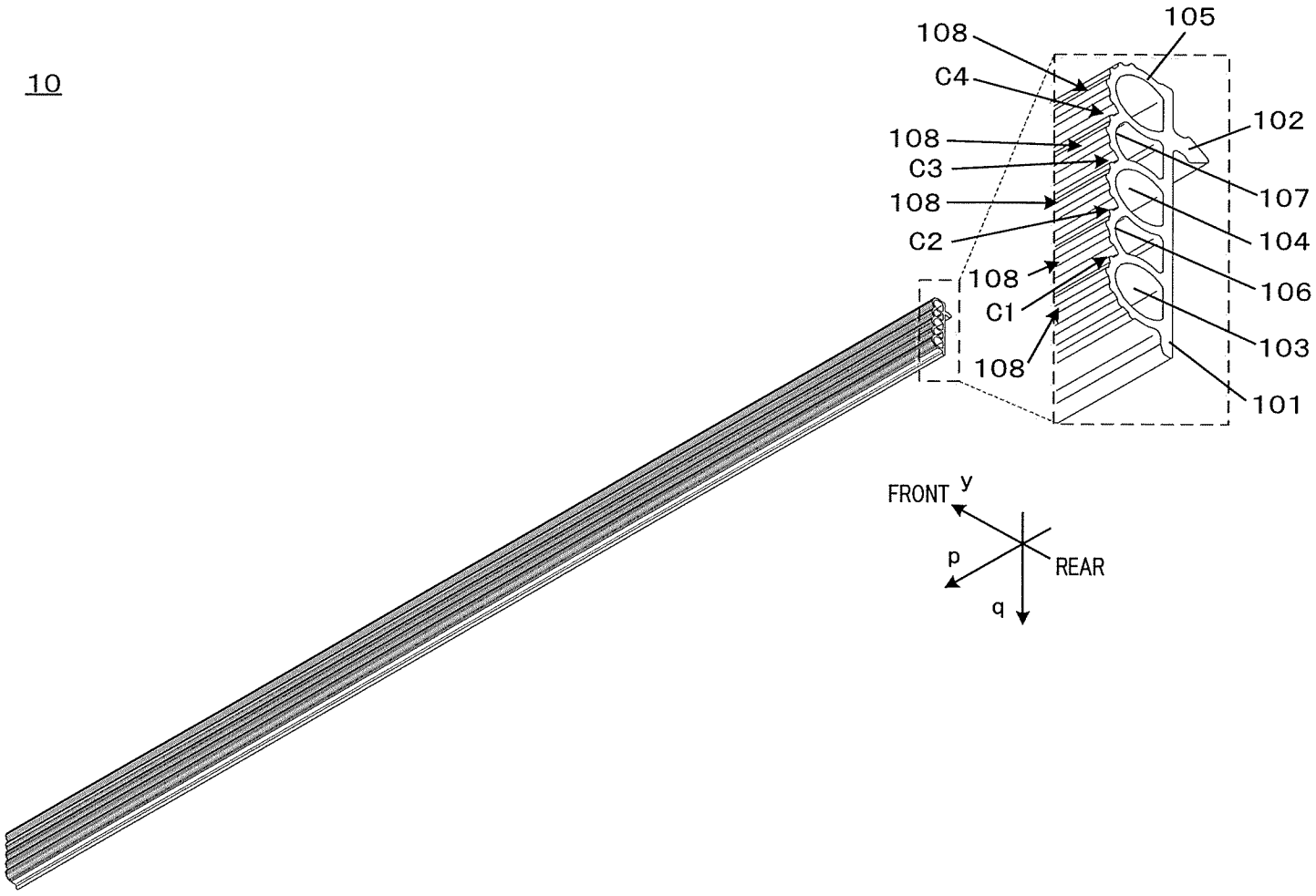
FIG. 5 is a perspective view illustrating a straight seal member immediately after extrusion molding.

FIG. 4A is an enlarged cross section of a front left portion of ultra-low temperature freezer 1 (with outer door 3 opened), as viewed in perspective from above, the cross section being taken along line IV-IV' of FIG. 3. FIG. 4B is an enlarged cross section of the front left portion of ultra-low temperature freezer 1 (with outer door 3 closed), as viewed in perspective from above, the cross section being taken along line IV-IV' of FIG. 3. To avoid complication of illustration, FIG. 4B does not have reference marks for constituent elements of seal member 10. FIG. 5 is a perspective view illustrating straight seal member 10 immediately after extrusion molding.

With reference to FIGS. 3 to 5, a detailed description is hereinafter provided of seal member 10.

As illustrated in FIGS. 4A and 4B, housing-end breaker 8 and door-end breaker 9 that are made of, for example, resin are preferably mounted to above-described housing-end peripheral part S4 and door-end peripheral part S11, respectively. Regardless of whether outer door 3 is opened or closed, housing-end breaker 8 is provided on peripheral part S4 to surround opening A1 in a plane viewed from a direction along the y-axis. On the other hand, door-end breaker 9 is provided on peripheral part S11 to surround opening A1 in a plane viewed in the direction indicated by the y-axis when outer door 3 is closed.

Seal member 10 is mounted over peripheral part S4 via above-mentioned housing-end breaker 8 to surround opening A1 in a plane viewed from the direction along the y-axis (refer to FIG. 3).

Seal member 10 is typically made by extrusion molding of an elastic material such as rubber or resin and subsequent bending into a shape conforming with a shape of peripheral part S4. This seal member 10 includes base 101, mounting part 102, first air layer defining part 103, second air layer defining part 104, third air layer defining part 105, first connecting part 106, second connecting part 107, and a plurality of ribs 108. It is preferable that seal member 10 be integrally molded with parts 101 to 107 forming an integral structure.

Base 101 has the shape of a rectangular frame in a plane viewed in the direction indicated by the y-axis and has a predetermined y-axis thickness. Base 101 is provided on housing-end breaker 8 to extend along the periphery of opening A1 in a plane viewed from the direction along the y-axis. An extending direction of base 101 is hereinafter referred to as extending direction p. As illustrated in FIG. 3, extending direction p is parallel to all sides of rectangular opening A1. In other words, extending direction p is parallel to the x-axis or the z-axis.

Mounting part 102 projects rearward from a rear face of base 101 (namely, from base 101 in the y-axis negative direction). This mounting part 102 is inserted into slit 81 that is formed in housing-end breaker 8, whereby seal member 10 is mounted to housing-end breaker 8.

Air layer defining parts 103 to 105 are hollow and are provided to surround the entire periphery of opening A1 from all quarters (namely, from above, below, left, and right) while projecting forward (i.e. in the y-axis positive direction) from a front face of base 101. Air layer defining parts 104, 105 line up in second direction q in predetermined spaced relation to respective air layer defining parts 103, 104. It is to be noted here that second direction q is orthogonal to extending direction p and the direction indicated by the y-axis (i.e. first direction). More specifically, air layer defining parts 103 to 105 line up in the direction indicated by the x-axis (i.e. in the transverse direction) with extending direction p being parallel to the z-axis. With the extending direction being parallel to the x-axis, air layer defining parts 103 to 105 line up in the direction indicated by the z-axis (i.e. in the vertical direction).

In the present embodiment, when air layer defining parts 103 to 105 are cut along a virtual plane that includes line IV-IV' with outer door 3 opened, as illustrated in FIG. 4A, air layer defining parts 103 to 105 each have an inner peripheral surface in the shape of an ellipse and an outer peripheral surface in the shape of an elliptical arc. It is to be noted here that the virtual plane is orthogonal to extending direction p and is parallel to the y-axis. The ellipses respectively defining respective cross-sectional shapes of the inner peripheral surfaces have identical curvature distributions. Similarly, the elliptical arcs respectively defining respective cross-sectional shapes of the outer peripheral surfaces have identical curvature distributions.

First connecting part 106 surrounds the entire periphery of opening A1 from all quarters in a plane viewed from the direction along the y-axis and connects the respective outer peripheral surfaces of air layer defining parts 103, 104 as a bridge between these outer peripheral surfaces. First connecting part 106 has substantially the same shape as a y-axis end portion of second air layer defining part 104. More specifically, an inner peripheral surface and an outer peripheral surface of first connecting part 106 are shaped like respective y-axis end portions of the second air layer defining part's inner and outer peripheral surfaces when a virtual parallel displacement is caused to these y-axis end portions. As such, the inner peripheral surface of first connecting part 106 forms an air layer with the respective outer peripheral surfaces of air layer defining parts 103, 104 and the front face of base 101.

Second connecting part 107 surrounds the entire periphery of opening A1 from all quarters in a plane viewed from the direction along the y-axis and connects the respective outer peripheral surfaces of air layer defining parts 104, 105 as a bridge between these outer peripheral surfaces. As with first connecting part 106, an inner peripheral surface of second connecting part 107 forms an air layer with the respective outer peripheral surfaces of air layer defining parts 104, 105 and the front face of base 101.

By including air layer defining parts 103 to 105 and connecting parts 106, 107 that each have the above structure, a y-axis end portion of seal member 10 is formed with four recesses C1 to C4 in total (i.e. first through fourth recesses C1 to C4) that surround opening A1 from all quarters with outer door 3 closed.

The respective outer peripheral surfaces of air layer defining parts 103 to 105 each having the above structure, the outer peripheral surface of connecting part 106 having the above structure, and an outer peripheral surface of connecting part 107 having the above structure are formed with the plurality of ribs 108 that project in the direction indicated by the y-axis.

1-5. Functional Effects of Seal Member

When closing outer door 3, the user operates lock mechanism 36 while pressing outer door 3 against housing 2 as illustrated in FIG. 4B, thereby securing outer door 3 to housing 2. Accordingly, door-end peripheral part S11 faces, via seal member 10, housing-end peripheral part S4 in a front to rear direction in close proximity to housing-end peripheral part S4. This is when seal member 10 is crushed between door-end breaker 9 and housing-end breaker 8, thereby contributing to maintenance of storage space A in the ultra-low temperature range.

This seal member 10 is formed with four recesses C1 to C4 in its y-axis end portion. Accordingly, moisture that remains between the y-axis end portion of seal member 10 and door-end breaker 9 when outer door 3 is closed is divided among recesses C1 to C4. Because of that, even when the moisture between the y-axis end portion of seal member 10 and door-end breaker 9 freezes in these recesses C1 to C4, there is a decreased area of contact between each of resulting ice pieces that are divided among recesses C1 to C4 and door-end breaker 9, thus enabling reduction of difficulty in opening outer door 3.

With seal member 10 being crushed because of closed outer door 3, the outer peripheral surfaces of seal member 10 that define recesses C1 to C4 move away from one another to expand respective openings of recesses C1 to C4, whereby recesses C1 to C4 become shallower. On the other hand, when seal member 10 is restored to its original shape as outer door 3 is opened, the outer peripheral surfaces come close to one another to make the respective openings of recesses C1 to C4 smaller, whereby recesses C1 to C4 become deeper. As such, when outer door 3 is opened, the ice pieces that have respectively frozen in recesses C1 to C4 with outer door 3 closed are forced out of recesses C1 to C4. Consequently, recesses C1 to C4 can have reduced remains. In this way, the difficulty in opening outer door 3 can be reduced. Moreover, cleaning of recesses C1 to C4 can be a lightened burden for the user.

In the present embodiment, the respective outer peripheral surfaces of air layer defining parts 103 to 105 and the respective outer peripheral surfaces of connecting parts 106, 107 are each provided with at least one rib 108 to be structurally preferable. As such, when outer door 3 is closed, the y-axis end portion of seal member 10 makes line contact with door-end breaker 9, whereby moisture that remains between the y-axis end portion and door-end breaker 9 can be divided with more reliability compared to cases where only recesses C1 to C4 are provided. Moreover, with the plurality of ribs 108 provided on the outer peripheral surfaces, an increased number of divided ice pieces can be obtained. An area of contact between each of the divided ice pieces and door-end breaker 9 decreases according to the number of divisions, so that even when moisture between the y-axis end portion of seal member 10 and door-end breaker 9 freezes between these ribs 108, the difficulty in opening outer door 3 can be reduced even further.

Connecting part 106 connects two adjacent air layer defining parts 103, 104 in spaced relation to the front face of base 101. The same goes for connecting part 107. Accordingly, recesses C1 to C4 are relatively shallow, thus facilitating cleaning of recesses C1 to C4 for the user. On the other hand, if there are no connecting parts 106, 107, cleaning must be done between air layer defining parts 103 and 104 as well as between air layer defining parts 104 and 105, thus being time-consuming for the user.

Seal member 10 has, in addition to respective air layers of air layer defining parts 103 to 105, the air layers respectively added by connecting parts 106, 107. Thus, the five air layers in total line up in second direction q, thereby enabling respective improvements in the hermeticity and the thermal insulation of ultra-low temperature freezer 1.

According to this seal member 10, the respective outer peripheral surfaces and the respective inner peripheral surfaces of air layer defining parts 103 to 105 each bend, at a midpoint of extension in the direction indicated by the y-axis, to be nonparallel to the y-axis. Both sides extending from that bending point are nonparallel to the y-axis. With this structure, each of air layer defining parts 103 to 105 easily crushes toward base 101 under a load from the direction along the y-axis.

The respective outer peripheral surfaces of air layer defining parts 103 to 105 have the identical curvature distributions. Similarly, the respective inner peripheral surfaces of air layer defining parts 103 to 105 have the identical curvature distributions. Also respective curvature distributions of the outer and inner peripheral surfaces of each of connecting parts 106, 107 are respectively identical to the respective curvature distributions of the outer and inner peripheral surfaces of air layer defining part 103 or the like. Moreover, an interval between adjacent air layer defining parts 103, 104 is equal to an interval between adjacent air layer defining parts 104, 105. As such, air layer defining parts 103 to 105 crush generally in a similar manner under a load that is applied to seal member 10 from the direction along the y-axis when outer door 3 is closed. Accordingly, with outer door 3 closed, external heat is not easily introduced into storage space A, whereby the hermeticity and the thermal insulation of ultra-low temperature freezer 1 become stable.

1-6. Modified examples

In the above description, air layer defining parts 103 to 105 each have a cross section of substantially elliptical shape, and connecting parts 106, 107 each have a cross section having the shape of an elliptical arc. However, this is not limiting. As illustrated in an uppermost row of FIG. 6, the cross section of each of air layer defining parts 103 to 105 may have the shape of a perfect circle. Here the cross section of connecting part 106 may be shaped like a y-axis end portion of the perfect circle of air layer defining part 104 when a virtual parallel displacement in second direction q is caused to this y-axis end portion.

There are other alternatives. As illustrated in a second row or a third row from a top in FIG. 6, the cross section of each of air layer defining parts 103 to 105 may have the shape of a hexagon or a pentagon. Here the cross section of connecting part 106, 107 may be shaped like a y-axis end portion of the hexagon or the pentagon of corresponding one of air layer defining parts 103 to 105 when a parallel displacement in the direction indicated by the x-axis is caused to this y-axis end portion.

There are still more alternatives. As illustrated in a fourth row or a fifth row from the top in FIG. 6, the cross section of each of air layer defining parts 103 to 105 may have the shape of a semicircle or a half ellipse. Here the cross section of connecting part 106, 107 may be shaped like a y-axis end portion of the semicircle or the half ellipse of corresponding one of air layer defining parts 103 to 105 when a parallel displacement in the direction indicated by the x-axis is caused to this y-axis end portion.

Figure 6:
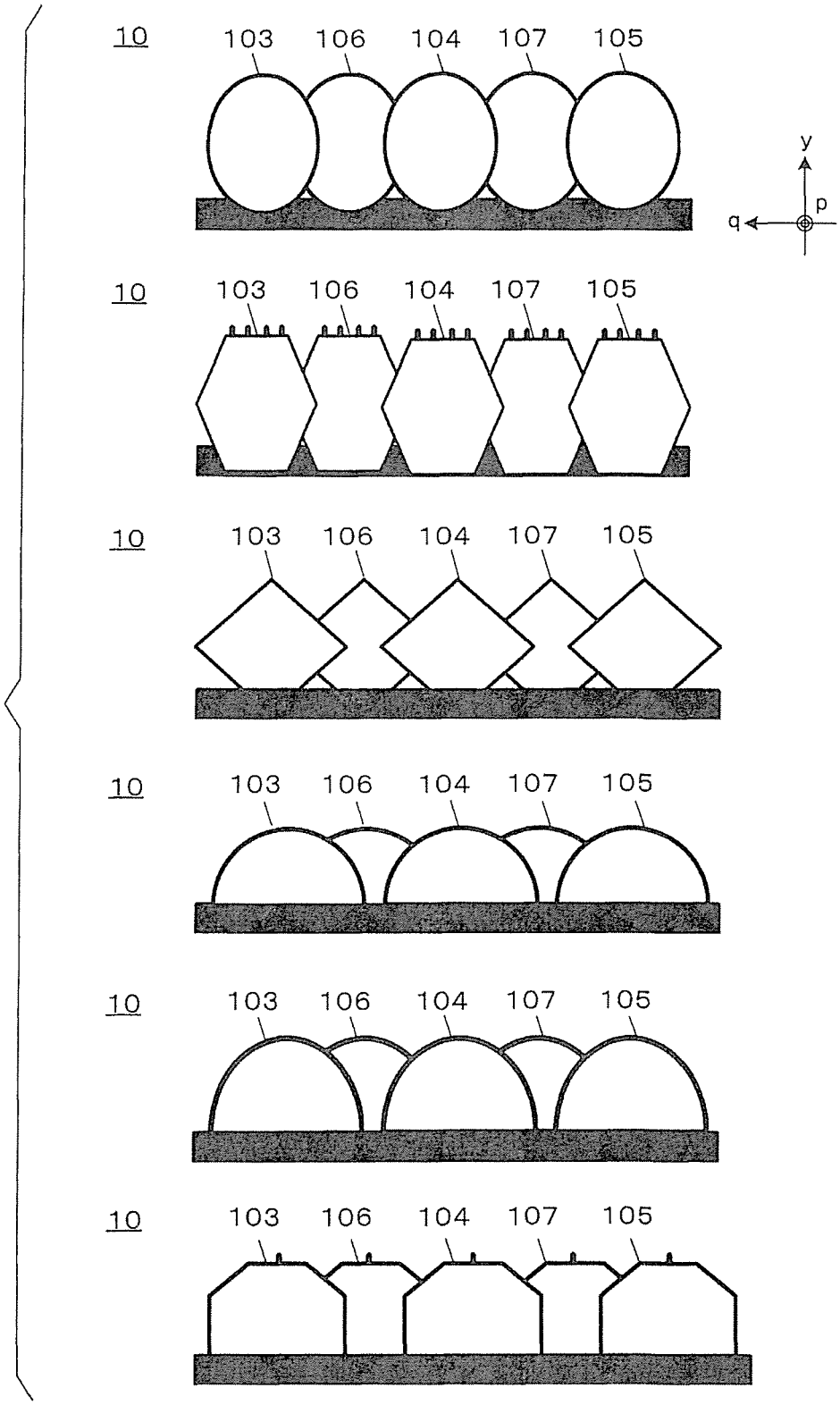
FIG. 6 illustrates respective cross sections of modified examples of the seal member.

Yet another alternative is that as illustrated in a lowermost row of FIG. 6, the cross section of each of air layer defining parts 103 to 105 may have the shape of a half octagon. Here the cross section of connecting part 106, 107 may be shaped like a y-axis end portion of the half octagon of corresponding one of air layer defining parts 103 to 105 when a parallel displacement in the direction indicated by the x-axis is caused to this y-axis end portion.

With air layer defining parts 103 to 105 illustrated in each of the fourth to lowermost rows from the top in FIG. 6, although not both sides of each of an inner and an outer peripheral surface extend from a bending point to be nonparallel to the y-axis, one of those sides is nonparallel to the y-axis. Even in this case, air layer defining parts 103 to 105 easily crush toward base 101 under a load from the direction along the y-axis.

1-7. Additional Remarks

In the above description, seal member 10 is provided over peripheral part S4 of housing 2. However, seal member 10 is not limited to this. Seal member 10 may be provided over peripheral part S11 of outer door 3.

Seal member 10 has been described as including three air layer defining parts 103 to 105 and two connecting parts 106, 107. However, seal member 10 is not limited to this. Seal member 10 only has to include at least two air layer defining parts and at least one connecting part.

The plurality of ribs 108 are not necessary constituent elements and may be provided as needed.

The present application claims priority to Japanese Patent Application No. 2016-048222 filed with the Japan Patent Office on Mar. 11, 2016. The contents of Japanese Patent Application No. 2016-048222 are hereby incorporated by reference into the present application.

INDUSTRIAL APPLICABILITY

An ultra-low temperature freezer according to the present disclosure can reduce freezing-induced difficulty in opening an outer door and thus is suitable for use in a biomedical application and others.

REFERENCE SIGNS LIST

1 Ultra-low temperature freezer
2 Housing
S4 Housing-end peripheral part
A1 Opening
3 Outer door
S11 Door-end peripheral part
10 Seal member
103 First air layer defining part
104 Second air layer defining part
105 Third air layer defining part
106 First connecting part
107 Second connecting part
C1 First recess
C2 Second recess
108 Rib

The invention claimed is:

1. An ultra-low temperature freezer comprising:

a housing including a first peripheral part around an opening;

a door mounted to the housing to be openable, the door including a second peripheral part that the first peripheral part faces in a first direction when the door is closed; and a seal member that is interposed between the first and second peripheral parts when the door is closed, wherein the seal member includes:

a first air layer defining part and a second air layer defining part that are hollow and line up in a second direction between the first and second peripheral parts when the door is closed, the first and second air layer defining parts being attached to one of the first and second peripheral parts; and a first connecting part bridging between the first air layer defining part and second air layer defining part, the first connecting part forming an air layer together with the first and second air layer defining parts, wherein an entire shape of the first connecting part is identical in shape and size to a portion of the first air layer defining part and a portion of the second air layer defining part, in a cross sectional view of the seal member taken along the second direction, wherein the portion of the first air layer defining part, the first connecting part, and the portion of the second air layer defining part are in direct contact with another of the first and second peripheral parts, and wherein the first connecting part forms a first recess that extends in the first direction with the first air layer defining part and forms a second recess that extends in the first direction with the second air layer defining part, irrespective of whether the door is closed, the first and second recesses facing the another of the first and second peripheral parts.

2. The ultra-low temperature freezer according to claim 1, wherein respective inner peripheral surfaces of the first and second air layer defining parts each include a portion that is nonparallel to the first direction.

3. The ultra-low temperature freezer according to claim 1, wherein respective inner peripheral surfaces of the first and second air layer defining parts each have the shape of a perfect circle or a circular arc and are identical in shape in a plane view taken in the first direction.

4. The ultra-low temperature freezer according to claim 1, wherein respective inner peripheral surfaces of the first and second air layer defining parts each have the shape of an ellipse or an elliptical arc and have identical curvature distributions in a plane view taken in the first direction.

5. The ultra-low temperature freezer according to claim 1, wherein respective inner peripheral surfaces of the first and second air layer defining parts each have the shape of a polygon and are identical in shape in a plane view taken in the first direction.

6. The ultra-low temperature freezer according to claim 1, wherein respective outer peripheral surfaces of the first and second air layer defining parts are each formed with a rib that projects toward the first peripheral part or the second peripheral part.

7. The ultra-low temperature freezer according to claim 1, wherein the seal member further includes:

a third air layer defining part that is hollow and lines up in the second direction with respect to the second air layer defining part between the first and second peripheral parts when the door is closed, the third air layer defining part being attached the one of the first and second peripheral parts; and a second connecting part bridging between the second air layer defining part and the third air layer defining part, the second connecting part forming an air layer together with the second and third air layer defining parts.

8. The ultra-low temperature freezer according to claim 7, wherein respective inner peripheral surfaces of the first, second and third air layer defining parts each include a portion that is nonparallel to the first direction.

9. The ultra-low temperature freezer according to claim 7, wherein respective inner peripheral surfaces of the first, second and third air layer defining parts each have the shape of a perfect circle or a circular arc and are identical in shape in a plane view taken in the first direction.

10. The ultra-low temperature freezer according to claim 7, wherein respective inner peripheral surfaces of the first, second and third air layer defining parts each have the shape of an ellipse or an elliptical arc and have identical curvature distributions in a plane view taken in the first direction.

11. The ultra-low temperature freezer according to claim 7, wherein respective inner peripheral surfaces of the first, second and third air layer defining parts each have the shape of a polygon and are identical in shape in a plane view taken in the first direction.

12. The ultra-low temperature freezer according to claim 7, wherein respective outer peripheral surfaces of the first to third air layer defining parts are each formed with a rib that projects toward the first peripheral part or the second peripheral part.

13. The ultra-low temperature freezer according to claim 7, wherein a spatial distance between the first and second air layer defining parts in the second direction is equal to a spatial distance between the second and third air layer defining parts in the second direction.

14. The ultra-low temperature freezer according to claim 13, wherein:

an entire shape of the second connecting part is identical in shape and size to the portion of the second air layer defining part and a portion of the third air layer defining part, in a cross sectional view of the seal member taken along the second direction;

the portion of the first air layer defining part, the first connecting part, the portion of the second air layer defining part, the second connecting part, and the portion of the third air layer defining part are in direct contact with the another of the first and second peripheral parts, and the second connecting part forms a third recess that extends in the first direction with the second air layer defining part and forms a fourth recess that extends in the first direction with an outer peripheral surface of the third air layer defining part, irrespective of whether the door is closed, the third and fourth recesses facing the another of the first and second peripheral parts.

* * * * *